US008951626B2

(12) United States Patent
Harlacher et al.

(10) Patent No.: US 8,951,626 B2
(45) Date of Patent: Feb. 10, 2015

(54) HYGIENE OR WIPING PRODUCT COMPRISING AT LEAST ONE PATTERNED PLY AND METHOD FOR PATTERNING THE PLY

(75) Inventors: Harald Harlacher, Mannheim (DE); Joachim Leonhardt, Mannheim (DE)

(73) Assignee: SCA Hygiene Products AB, Gothenburg (SE)

( * ) Notice: Subject to any disclaimer, the term of this patent is extended or adjusted under 35 U.S.C. 154(b) by 94 days.

(21) Appl. No.: 12/936,691

(22) PCT Filed: Apr. 7, 2008

(86) PCT No.: PCT/EP2008/054144

§ 371 (c)(1), (2), (4) Date: Oct. 7, 2010

(87) PCT Pub. No.: WO2009/124581

PCT Pub. Date: Oct. 15, 2009

(65) Prior Publication Data

US 2011/0027545 A1 Feb. 3, 2011

(51) Int. Cl.
*B29C 65/00* (2006.01)
*B32B 37/00* (2006.01)
(Continued)

(52) U.S. Cl.
CPC ..... *D21H 21/28* (2013.01); *D21H 21/32* (2013.01); *D21H 27/002* (2013.01); *D21H 27/02* (2013.01); *D21H 27/30* (2013.01)
USPC ..... 428/195.1; 156/281; 8/102; 8/406

(58) Field of Classification Search
CPC ..... A61F 13/1577; A61F 13/15617; A61F 13/15626; A61F 13/15634; A61F 13/1565; A61F 13/1511; A61F 13/15; A61F 13/47; A61F 13/471; A61F 13/472; A61F 13/475; A61F 13/49; A61F 13/00; A61F 5/44; A47K 7/00; A47K 10/00; A47K 10/16; A47K 2010/00; D21H 21/00; D21H 21/32; D21H 21/28; D21H 27/30; D21H 27/02; D21H 27/002; D21H 27/32
USPC ..... 8/102; 156/275.1, 275.3, 291, 305, 60, 156/73.1, 73.6, 131, 163, 244.22
See application file for complete search history.

(56) References Cited

U.S. PATENT DOCUMENTS 5,131,913 A * 7/1992 Martini ..... 8/448
5,209,953 A 5/1993 Grupe et al.
(Continued)

FOREIGN PATENT DOCUMENTS

DE 41 15 575 A1 11/1992
DE 196 27 910 A1 1/1998
(Continued)

OTHER PUBLICATIONS

Dyeing With Bleach, Threads Magazine, Oct. 28, 2008; http://www.threadsmagazine.com/item/3720/dyeing-with-bleach/page/all.*
(Continued)

*Primary Examiner* — Mark Ruthkosky
*Assistant Examiner* — Laura C Powers
(74) *Attorney, Agent, or Firm* — Drinker Biddle & Reath LLP

(57) ABSTRACT

A hygiene or wiping product includes at least one ply of a fibrous web containing cellulose fibers and having a graphical pattern of at least first and second areas. The ply contains a coloring compound providing a coloration of the ply in the first area. The coloring compound is at least partly chemically destroyed in the second area so that the ply is less colored in the second area than in the first area. A method for producing such a ply includes the steps of providing a fibrous web containing a coloring compound, which provides a uniform coloration in at least a portion of the web, and applying a bleaching agent to a part of the colored portion of the web to at least partly decolor the web in the part generating a pattern of at least first colored and second less colored areas.

10 Claims, 1 Drawing Sheet

(51) Int. Cl.

| | |
|---|---|
| ***D06L 3/00*** | (2006.01) |
| ***D06L 3/16*** | (2006.01) |
| ***D21H 21/28*** | (2006.01) |
| *D21H 21/32* | (2006.01) |
| *D21H 27/00* | (2006.01) |
| *D21H 27/02* | (2006.01) |
| *D21H 27/30* | (2006.01) |

(56) References Cited

U.S. PATENT DOCUMENTS

| | | | | |
|---|---|---|---|---|
| 6,322,596 | B1 * | 11/2001 | Kish et al. | 8/401 |
| 2007/0178288 | A1 * | 8/2007 | Andersson et al. | 428/198 |
| 2008/0271863 | A1 * | 11/2008 | Zoller et al. | 162/109 |
| 2008/0294140 | A1 * | 11/2008 | Ecker et al. | 604/385.23 |

FOREIGN PATENT DOCUMENTS

| | | | |
|---|---|---|---|
| DE | 201 15 634 | U1 | 12/2001 |
| DE | 20 2005 018311 | U1 | 1/2006 |
| EP | 0 414 015 | A2 | 2/1991 |
| EP | 0 514 901 | A2 | 11/1992 |
| EP | 0 514 901 | B1 | 9/1995 |
| EP | 1 516 956 | A1 | 3/2005 |
| JP | 2003310476 | A | 11/2003 |
| KR | 20070105621 | A | 10/2007 |
| RU | 2211271 | C2 | 6/2002 |
| WO | 89/02952 | A1 | 4/1989 |
| WO | 96/20310 | A1 | 7/1996 |
| WO | 00/32874 | A1 | 6/2000 |
| WO | 01/54909 | A2 | 8/2001 |
| WO | 02/27098 | A1 | 4/2002 |
| WO | 03/044278 | A2 | 5/2003 |
| WO | 2006/136186 | A1 | 12/2006 |
| WO | 2007/058289 | A1 | 5/2007 |
| WO | 2008/011523 | A2 | 1/2008 |

OTHER PUBLICATIONS

Bleach Stenciling with Doilies, Cut out & Keep website via Internet Wayback Machine, Jan. 26, 2010; http://web.archive.org/web/20100126190124/http://www.cutoutandkeep.net/projects/bleach_stencling_with_doilies.*

Discharge Printing, Indianzone Textile website via Internet Wayback Machine, Jun. 2, 2009; http://web.archive.org/web/20090602090312/http://textiles.indianetzone.com/1/discharge_printing.htm.*

International Search Report, dated May 26, 2009, from corresponding PCT application.

Translation of Decision on Grant, dated Apr. 5, 2012, from corresponding Russian patent application No. 2010144965.

Office Action dated Jun. 12, 2013, with partial English-language translation, from corresponding Colombian patent application No. 10.137.662.

* cited by examiner

HYGIENE OR WIPING PRODUCT COMPRISING AT LEAST ONE PATTERNED PLY AND METHOD FOR PATTERNING THE PLY

TECHNICAL FIELD

The present invention relates to a hygiene or wiping product comprising at least one ply of a fibrous web containing cellulosic fibers and having a graphical pattern of at least first and second areas, the ply containing a coloring compound providing a coloration of the ply in the first areas. The present invention further relates to a method for graphically patterning a ply of a fibrous web comprising cellulosic fibers.

BACKGROUND OF THE INVENTION

The fibrous web may be tissue paper or non-woven, but preferably is tissue paper. In the method and product of the present invention, plies of the same or a different material may be combined.

A tissue paper is defined as a soft absorbent paper having a low basis weight. One generally selects a basis weight of 8 to 40 g/m2, especially 10 to 25 g/m2 per ply. The total basis weight of multiple-ply tissue products is preferably equal to a maximum of 100 g/m2, more preferably to a maximum of 65 g/m2. Its density is typically below 0.6 g/cm3, preferably below 0.30 g/cm3 and more preferably between 0.08 and 0.20 g/cm3.

The production of tissue is distinguished from paper production by its extremely low basis weight and its much higher tensile energy absorption index (see DIN EN 12625-4 and DIN EN 12625-5). Paper and tissue paper also differ in general with regard to the modulus of elasticity that characterizes the stress-strain properties of these planar products as a material parameter.

A tissue's high tensile energy absorption index results from the outer or inner creping. The former is produced by compression of the paper web adhering to a dry cylinder as a result of the action of a crepe doctor or in the latter instance as a result of a difference in speed between two wires ("fabrics"). This causes the still moist, plastically deformable paper web to be internally broken up by compression and shearing, thereby rendering it more stretchable under load than an uncreped paper.

Moist tissue paper webs are usually dried by the so-called Yankee drying, the through air drying (TAD) or the impulse drying method.

The fibers contained in the tissue paper are mainly cellulosic fibers, such as pulp fibers from chemical pulp (e.g. Kraft sulfite and sulfate pulps), mechanical pulp (e.g. ground wood), thermo mechanical pulp, chemo-mechanical pulp and/or chemo-thermo mechanical pulp (CTMP). Pulps derived from both deciduous (hardwood) and coniferous (softwood) can be used. The fibers may also be or include recycled fibers, which may contain any or all of the above categories. The fibers can be treated with additives—such as fillers, softeners, such as quaternary ammonium compounds and binders, such as conventional dry-strength agents or wet-strength agents used to facilitate the original paper making or to adjust the properties thereof. The tissue paper may also contain other types of fibers, e.g. regenerated cellulosic fibers or annual plant fibers such as sisal, hemp or bamboo fibers, or synthetic fibers enhancing, for instance, strength, absorption, smoothness or softness of the paper.

If tissue paper is to be made out of pulp, the process essentially comprises a forming that includes a box and a forming wire portion, and a drying portion (either through air drying or conventional drying on a yankee cylinder). The production process also usually includes the crepe process essential for tissues and, finally, typically a monitoring and winding area.

Paper can be formed by placing the fibers, in an oriented or random manner, on one or between two continuously revolving wires of a paper making machine while simultaneously removing the main quantity of water of dilution until dry-solids contents of usually between 12 and 35% are obtained.

Drying the formed primary fibrous web occurs in one or more steps by mechanical and thermal means until a final dry-solids content of usually about 93 to 97% has been reached. In case of tissue making, this stage is followed by the crepe process which crucially influences the properties of the finished tissue product in conventional processes. The conventional dry crepe process involves creping on a usually 4.0 to 6.5 m diameter drying cylinder, the so-called yankee cylinder, by means of a crepe doctor with the aforementioned final dry-solids content of the raw tissue paper. Wet creping can be used as well, if lower demands are made of the tissue quality. The creped, finally dry raw tissue paper, the so-called base tissue (base paper), is then available for further processing into the paper product for a tissue paper product.

Instead of the conventional tissue making process described above, the use of a modified technique is possible in which an improvement in specific volume is achieved by a special kind of drying which leads to an improvement in the bulk softness of the tissue paper. This process, which exists in a variety of subtypes, is termed the TAD (Through Air Drying) technique. It is characterized by the fact that the "primary" fibrous web that leaves the forming and sheet making stage is pre-dried to a dry-solids content of about 80% before final contact drying on the yankee cylinder by blowing hot air through the fibrous web. The fibrous web is supported by an air-permeable wire or belt or TAD-fabric and during its transport is guided over the surface of an air-permeable rotating cylinder drum, the so-called TAD-cylinder. Structuring the supporting wire or belt makes it possible to produce any pattern of compressed zones broken up by deformation in the moist state, also named moulding, resulting in increased mean specific volumes and consequently leading to an increase of bulk softness without decisively decreasing the strength of the fibrous web.

The term non-woven (ISO 9092, DIN EN 29092) is applied to a wide range of products which, in terms of their properties, are located between those of paper (cf. DIN 6730, May 1996) and cardboard (DIN 6730) on the one hand, and textiles on the other hand. As regards non-woven a large number of extremely varied production processes are used, such as the air-laid and spun-laced techniques as well as wet-laid techniques. The non-woven includes mats, non-woven fabrics and finished products made thereof. Non-wovens may also be called textile-like composite materials, which represent flexible porous fabrics that are not produced by the classic methods of weaving warp and weft or by looping. In fact, non-wovens are produced by intertwining, cohesive or adhesive bonding of fibers, or a combination thereof. The non-woven material can be formed of natural fibers, such as cellulose or cotton fibers, but can also consist of synthetic fibers, such as Polyethylene (PE), polypropylene (PP), polyurethane (PU), polyester, nylon or regenerated cellulose, or a mix of different fibers. The fibers may, for example, be present in the form of endless fibers of pre-fabricated fibers of a finite length, as synthetic fibers produced in situ, or in the form of staple fibers. The non-wovens according to the invention may thus consist of mixtures of synthetic and cellulose fibrous material, e.g. natural vegetable fibers (see ISO 9092, DIN EN 29092).

The fibrous web may be converted to the final hygiene or wiping product in many ways, for example, by embossing and/or laminating it into a multi-ply product, rolled or folded.

Hygiene or wiping products primarily include all kinds of dry-creped tissue paper, wet-creped paper, TAD-paper (Through Air Drying) and cellulose or pulp-wadding or all kinds of non-wovens, or combinations, laminates or mixtures thereof. Typical properties of these hygiene and wiping products include the reliability to absorb tensile stress energy, their drapability, good textile-like flexibility, properties which are frequently referred to as bulk softness, a higher surface softness and a high specific volume with a perceptible thickness. A liquid absorbency as high as possible and, depending on the application, a suitable wet and dry strength as well as an appealable visual appearance of the outer product's surface are desired. These properties, among others, allow these hygiene and wiping products to be used, for example, as cleaning wipes such as paper or non-woven wipes, windscreen cleaning wipes, industrial wipes, kitchen paper or the like; as sanitary products such as for example bathroom tissue, paper or non-woven handkerchiefs, household towels, towels and the like; as cosmetic wipes such as for example facials and as serviettes or napkins, just to mention some of the products that can be used. Furthermore, the hygiene and wiping products can be dry, moist, wet, printed or pretreated in any manner. In addition, the hygiene and wiping products may be folded, interleaved or individually placed, stacked or rolled, connected or not, in any suitable manner.

Due to the above description, the products can be used for personal and household use as well as commercial and industrial use. They are adapted to absorb fluids, remove dust, for decorative purposes, for wrapping or even just as supporting material, as is common for example in medical practices or in hospitals.

To produce multi-ply tissue paper products, such as handkerchiefs, bathroom paper, towels or household towels, an intermediate step often occurs with so-called doubling in which the base tissue in the desired number of plies of a finished product is usually gathered on a common multi-ply mother reel.

In the final hygiene or wiping product one or more of the fibrous webs may be combined. Thereby webs of the same material, for example tissue paper or non-woven may be combined or webs of a different material forming hybrid products. In the latter a tissue paper may be combined with a non-woven, a doubled fibrous web consisting of tissue paper and non-woven may be combined with a tissue paper, with a non-woven or with another doubled fibrous web consisting of a tissue paper and a non-woven. Hence, any arbitrary combination of fibrous webs consisting of different or the same material may be combined according to the present invention to form the final hygiene or wiping product. In addition, one ply in itself may be a hybrid in regard that different types of fibers are used in one and the same ply. A hybrid product may also be obtained in that tissue paper plies which are manufactured by different methods (for example TAD and conventional) are combined.

PRIOR ART

It is common practice to provide today's hygiene or wiping products with a graphical pattern of at least first and second elements defining first and second areas. In all these methods a substantially uncolored, white or bleached base paper is used and a coloring compound is in the one or other manner applied to the uncolored base paper so as to obtain a graphical pattern with graphical elements which are colored. Hence, these known hygiene or wiping products comprise at least one ply which has the graphical pattern of at least first and second areas, wherein the second areas constituting the graphical elements are colored, whereas the first areas, i.e. that area of the ply not containing the graphical element, remains uncolored (white) or substantially white.

One such hygiene or wiping product is e.g. known from DE 20 2005 018 311 U1. The method for providing such a ply substantially resides in the steps of providing two uncolored, white or substantially white base paper webs, wherein one of the webs is embossed generating the graphical element. In this process, a colored adhesive is applied to the web in areas corresponding to the tops of embossing protuberances of the used embossing roller. Subsequently, this web is brought together in a roller nip with a second web. By means of the colored adhesive which is applied to the web in areas corresponding to the embossed graphical element, the graphical element and, hence, the ply in areas which define the graphical element is colored, whereas the remaining areas remain white or substantially white.

Another possibility is to provide a white or substantially white base paper which is printed in a printing device, wherein a coloring compound, such as ink, is applied to the white or substantially white base web in the shape of the graphical element. Hence, the resulting patterned ply comprises a first area defined by that portion of the web which is not provided with the graphical element and a second area which is defined by the graphical element, wherein the second area is provided with a coloration and the first area remains white or substantially white. Such a printing machine is for example known from WO 01/54909 A2.

Moreover and similar to the use of colored adhesive as described in DE 20 2005 018 311 U1 the possibility exists to use ink instead of the adhesive and apply only ink to the base paper in that area of the web which corresponds to the top surfaces of the embossing protuberances of the embossing roller. In this instance, the embossed graphical elements will as well be colored and define the aforesaid second areas, wherein the remaining parts of the web which are unembossed remain uncolored and represent the first area, i.e. a portion of the web which remains uncolored.

Beside the purpose of improving the visual appearance of the final products, the graphical pattern may also be used to identify the product so that the public corresponds the visual appearance with the manufacturer.

In view of the aforesaid and because of the increasing use of graphical pattern as described above, i.e. a colored graphical pattern on a white or substantially white (uncolored) base paper, there is an increasing need for differentiating own products from the competitors by means of the visual appearance of the product for which purpose a new possibility for such patterns had to be developed. In addition, a further aim is to improve the visual appearance and increase the flexibility of possible designs.

A further problem with existing products is that the coloring compound may bleed into the remaining parts of the web, if wetted. Because of a wicking effect, the coloring compound in printing migrates into the fibers. Hence, a sharply contoured graphical element may not in all circumstances be obtainable.

An even further problem with existing products is that the coloring compound, applied to the base web either by printing or together with the glue for ply bonding, is difficult to handle and may soil the machines.

SUMMARY OF THE INVENTION

Therefore, the object of the present invention is to provide a hygiene or wiping product as described in the introduction which does not (or in a reduced manner) encompass the mentioned bleeding of the coloring compound when wetted, provides for a sufficient distinction from known products on the market and has an improved visual appearance at the same time improving the handling during manufacture particularly with respect to soiling of the machines. An additional object of the present invention is to provide a method for obtaining such a product in a simple and cost effective manner preferably without the need of new equipment, i.e. by means of existing equipment.

The basic principle of the present invention is to use a colored base paper (base web), which is colored at least in portions, and subsequently bleach the web in the colored portion so as to produce the graphical element (pattern element), e.g. a feather, a leaf, a slogan, a brandname/tradename, straight or curved lines, geometrical areas (triangles, circles, squares, rectangles etc.) etc., whereby the graphical pattern comprising first and second areas is provided, the first area being colored and the second area being at least partially decolored forming the graphical element. This opens up the possibility for various designs such as brighter or even white graphical or pattern element/-s on a colored base web, wherein the white graphical or pattern element/-s may be located in areas at which two or more plies are bonded or at different independent locations.

Subsequent to the bleaching step, the brighter or even white element/-s may again be provided with a coloring in only parts or portions of their area by means of colored adhesive together with ply bonding and/or printing or any other suitable means. The bleaching may be effected in the converting to the final product and/or immediately downstream of the paper making machine, e.g. in or downstream of the doubling machine. In addition, the bleached second area may be partly surrounded by a print or colored adhesive in a different or darker color than coloring compound the base paper to increase the contrast.

The hygiene or wiping product of the present invention as defined in the introduction comprises at least one ply of a fibrous web containing cellulosic fibers and having a graphical pattern of at least first and second areas, the ply containing a coloring compound such as dyes or pigments. The coloring compound provides a coloration of the ply in the first area, that is the coloring compound absorbs certain wavelengths of light preferentially so that the areas containing the coloring compound appear colored. The hygiene or wiping product is characterized in that this coloring compound is at least partially chemically converted to a non-coloring compound in the second area, thereby preferentially removing or at least reducing the capacity of the coloring compound to absorb certain wavelengths of light. In other words, the second area of the at least one ply of a fibrous web is subjected to a decoloring treatment, wherein the coloring compounds in this second area lose at least partially their ability to absorb visible light of certain wavelengths. That is, the non-coloring compound is a reaction product of the chemical convertion reaction of the coloring compound present in the first area of the at least one ply of a fibrous web. The chemical convertion of the coloring compound to the non-coloring compound is effected by means of bleaching the coloring compound. Accordingly, the non-coloring compound does not any longer has the capacity to absorb certain wavelengths of light. Although still containing the decolored coloring compound, the second area does no longer appear colored or at least no longer appear as colored as the first area. This according to the present invention is obtained in that the coloring compound loses its chromophoric characteristic. Therefore, in the inventive product the first area is a colored area and the second area, which defines the graphical element, is decolored or less colored than the first area. In this context, the first area may be the remaining part of the fibrous web except the second area so that the base paper/web in general is uniformly colored across its entire surface with the exception of the graphical elements, in which the web is less colored or completely decolored to obtain the graphical element.

The hygiene or wiping product in regard of the graphical pattern is sharply contoured and no bleeding (of the bleaching agent (see later)) has been observed.

As mentioned above, the coloring compound may be a dye-stuff or a pigment. The pigment may be an organic or an inorganic pigment. The organic or inorganic pigment is decolored by means of bleaching agent. In the same way the dye-stuff may be decolored by means of a bleaching reaction with a bleaching agent. In other words, the coloring compound is a bleachable compound losing its color characteristics due to the reaction with the bleaching agent. Suitable bleaching agents are oxidizing agents or reducing agents.

Mainly for manufacturing reasons the coloring compound should be a dyestuff and preferably an organic dyestuff having a great affinity to cellulose fibers. For example, the dyestuff may be a cationic direct dye stuff such as CARTASOL KRL 80% F from Sandoz. Other possible dye stuffs are dyes of the KAPPA-FLEX series from Kapp-Chemie, Minden, Germany. The base paper may be colored by means of various known processes such as applying the dyestuff onto a reel or sheet pulp before defibering and dispersing the reel or sheet pulp in a liquid or foam together possibly with other fibers as for example described in WO 96/20310 Al or adding the dyestuff to the fibers while they still are in a water suspension such as described in WO 89/02952 AI. In a preferred embodiment, the coloring compound is an oxidizable dyestuff and the dyestuff is at least partially oxidized in the second areas thereby losing the capacity of the coloring compound of absorbing certain wavelengths so that the second area appears less colored than the first area or even completely decolored.

In addition, the ply in a preferred embodiment has an embossing in at least the second area, which may be imparted by using existing systems e.g. for applying an adhesive. A further advantage of the inventive product according to this embodiment is that the less or completely decolored second area is additionally embossed so as to provide for a 3-dimensional effect. The 3-dimensional may also be obtained by only applying the bleaching agent instead of the adhesive such as for example described in WO 02/27098 A1. On the other hand, however, a bleaching agent may also be printed onto the colored base web by means of existing printing units as e.g. described in WO 01/54909 A2. However, thereby, no 3-dimensional effect is obtained.

Nowadays hygiene or wiping products in general comprise at least two, in most cases even more, plies. According to a preferred embodiment the two plies are bonded within the second area. However, additional bonding sites outside the second area may also be incorporated. In a preferred embodiment the two plies are adhesively bonded within the second area. As will be described later, this provides for the possibility to use existing equipment for producing the hygiene or wiping product of the present invention and adding a bleaching agent to the adhesive and applying a mixture of bleaching agent and adhesive to the one or more plies before bonding the one or more plies together so that an existing adhesive applicator unit may be used. In addition, it is to be noted that the at least two plies according to this embodiment may be of a different or the same material and/or may have different or the same properties. For example a tissue paper ply and a non-woven ply may be combined resulting in a hybrid product. On the other hand also two tissue paper plies having the same or different properties or two non-woven plies may be brought together. This embodiment combines ply bonding with the above described 3-D effect.

According to an additional or alternative configuration, the hygiene or wiping product may comprise a functional compound within the second area, that is for example lotion, scent, cleaner, antibacterials, etc. This provides the possibility to mix the bleaching agent with the functional compound so that in the resulting product, the parts (second area) in which the functional compound is disposed are less or completely decolored compared to the remaining portion (first area) of the product. This provides for an easy possibility to mark the locations at which the functional compound is disposed.

According to a preferred embodiment, the fibrous web is a tissue paper web, wherein the base paper is colored in that at least some fibers are colored.

The method of the present invention for graphically patterning a ply of a fibrous web comprising cellulosic fibers comprises the steps of providing a fibrous web containing a coloring compound providing a uniform coloration in at least a portion of the web. Preferably, however, a fibrous web being uniformly colored across the entire surface is used as a base paper (the entire web is uniformly colored). Further, the method comprises the step of applying a bleaching agent to the colored portion of the web to at least partially decolor the web in said portion generating a pattern of at least first colored and second less colored areas, wherein the first area is the area outside the part on which the bleaching agent is applied and the second area is defined by the part on which the bleaching agent is applied and defining the graphical element.

The amount of bleaching agent applied to the web influences the results. That is, the more bleaching agent is supplied the more decoloring is effected. Therefore, by adjusting the amount of bleaching agent applied to the ply, color nuances may be produced so that the graphical element (second area), in fact, has the same color as the base web (first area) but lighter in color.

The amount of bleaching agent may be influenced in the case existing adhesive applicator units are used by means for example of the speed of the Anilox roll (see later). In using a printing unit the grid pattern may be more or less dense so that more or less bleaching agent is applied in the printing step.

In addition, it is to be mentioned that it has been observed that wet strength agents in the fibrous web reduce the effect of decoloring which should be taken into account in selecting the amount of bleaching agent used.

An additional advantage of the present invention is that compared to the use of colored adhesive or ink in the converting machine, the use of bleaching agent does not soil the converting machine. Furthermore, the product will not contain any chloride as the remainder of chloride during drying of the product is volatilized. Also the problem of losing color by rubbing a web product against a subject or for example the face is less high in the inventive product, because the coloration is already incorporated in the step of manufacturing the paper and the bleaching agent may not lose color.

Preferably, the bleaching agent is selected from the group consisting of a Javel water (KClO, NaClO, CaClO, etc.), hydrogen peroxide/hydrazine. However, other suitable bleaching agents are also conceivable. A particularly suitable bleaching agent is calcium hypochlorite (CaClO) of Carl Roth GmbH & Co. KG, Karlsruhe, Germany, hydrogen peroxide PERDROGEN® 30%-weight of Sigma-Aldrich Chemie GbmH, Steinheim, Germany or a solution of sodium hypochlorite; 12% chlorine; of Carl Roth GmbH & Co. KG, Karlsruhe, Germany.

According to a preferred embodiment and with reference to the aforesaid the coloring compound is preferably an oxidizable dyestuff, wherein the bleaching agent is adapted to at least partly oxidize the coloring compound.

As previously mentioned and for the purpose of using existing equipment it is preferred that the bleaching agent is supplied concurrently with an adhesive (mixture of bleaching agent and adhesive), the method further comprising the steps of providing an additional ply of a fibrous web and bonding the ply by means of the adhesive. An example of a particularly useful adhesive for this purpose is CELLURA MC60 of Henkel, Germany, wherein the mixture preferably is NaClO of Carl Roth GmbH, Germany with between 3% to 8%, preferably 4 to 5% solid content CELLURA.

According to an alternative or additional embodiment, the bleaching agent is supplied concurrently with a functional compound as described above.

Further, and in order to prevent precipitation in the mixture of adhesive or functional compound and bleaching agent the mixture is continuously agitated before applying to the web.

BRIEF DESCRIPTION OF THE DRAWINGS

Further features and advantages of the present invention will become apparent from the following description of a preferred embodiment. In this description, reference is made to the accompanying drawings, in which.

DETAILED DESCRIPTION OF THE PREFERRED EMBODIMENT

Figure 1:
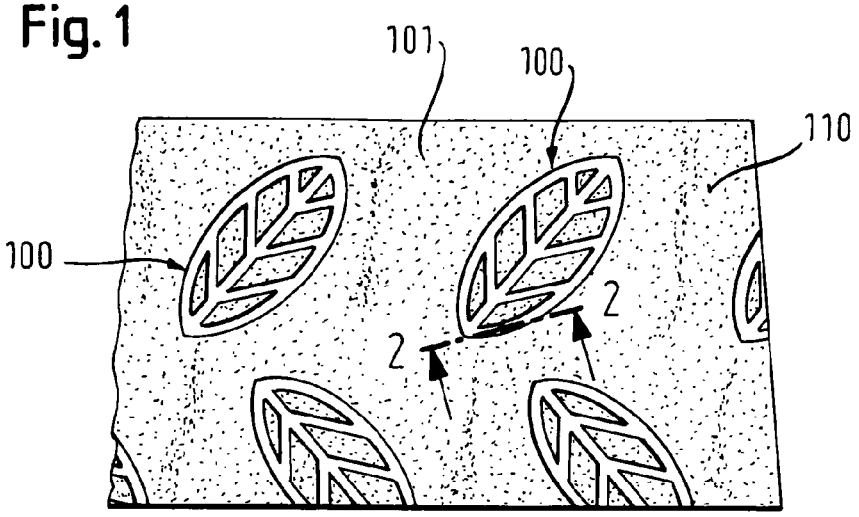
FIG. 1 shows a perspective view of a hygiene product according to the present invention.

FIG. 1 is a perspective view of a multi-ply toilet paper made of tissue paper comprising two plies, an upper ply 101 and a lower ply 102. One sheet of the toilet paper is depicted. The upper ply 101, which is shown in bird's view in FIG. 1, is a fibrous ply of tissue paper containing cellulose fibers. The second ply 102 may be of the same or a different material. The toilet paper has a graphical pattern with graphical elements 100 in the form of leaves. The leaves form the second area of the pattern, whereas the remaining parts 110 of the upper ply constitute the first area. In the shown embodiment, the first area 110 is provided with a coloration, e.g. light blue and, therefore, contains a coloring compound which has the capacity of absorbing certain wavelength of light preferentially so that the first area 110 appears light blue. The second area in form of the leaves 100 in the present embodiment is less colored than the first area 110. That is, the leaves have a blue color which is lighter than the light blue of the first area 110. On the other hand, it is also conceivable that the leaves 100 and, hence, the second area is entirely decolored being white or substantially white. In this case, the second area will substantially have the color of the base paper's fibers before coloration. The coloring compound providing for the light blue in the first area 11 is at least partially chemically destroyed in the second area 100. In particular, the coloring compound is an oxidizable dyestuff which in the second area 100 is oxidized loosing its capacity to absorb some wavelengths of light preferentially so that the second area 100 appears lighter blue or even decolored, white or substantially white.

In addition, the shown product is additionally embossed in the second area 100 so that the second area 100 is recessed (see FIG. 2) compared to the upper surface of the remaining parts (first area 110). The tissue material is compressed in this second embossed area. Thereby a 3-dimensional effect is obtained. In addition, the shown product is a two or more ply product, wherein the plies are at least adhesively bonded within the second area 100, that is within the leaves 100, preferably in the entire second area 10 by means of adhesive 103. In the manufacturing process the adhesive is mixed with a bleaching agent so as to achieve the decoloring in the second area 100 of the upper ply 101.

Figure 3:
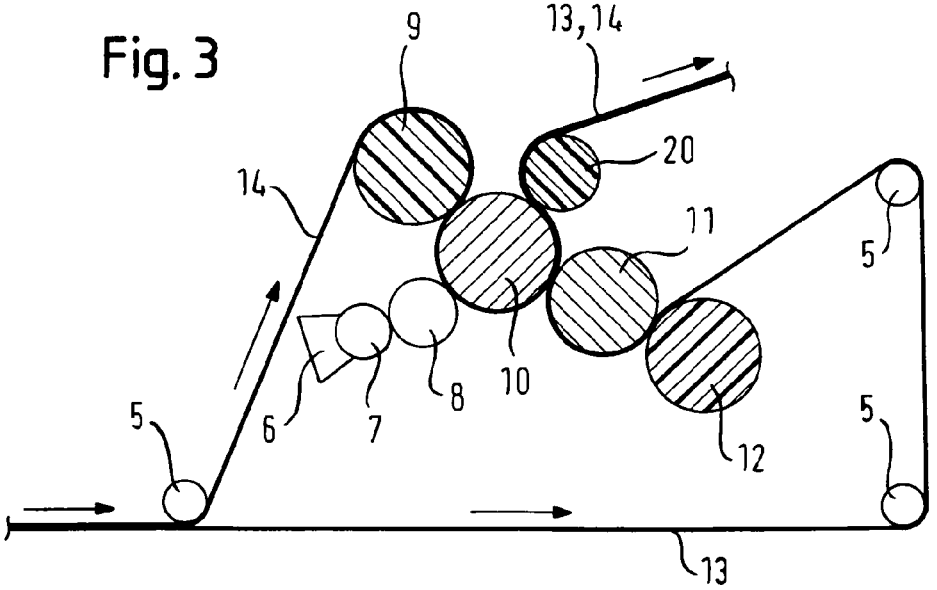
FIG. 3 depicts an apparatus suitable for providing the pattern shown in FIG. 1.

The process for manufacturing the shown product is described with respect to FIG. 3.

Figure 2:
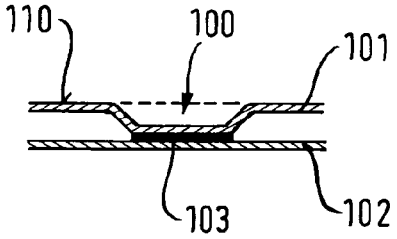
FIG. 2 shows a schematic cross-section along the line 2-2 in FIG. 1.

FIG. 2 shows an apparatus used for a method according to the present invention. The shown apparatus in its structural features beside the following differences equals an apparatus for embossing and ply bonding in a nested configuration. In regard of these prior art apparatuses reference is made to for example WO-A-2006/136 186.

The apparatus comprises a first roller 10 and a second roller 20.

The first roller 10 is an embossing roller made of steel. The embossing roller comprises a plurality of embossing protuberances (not shown) being provided on the outer periphery. In one preferred embodiment, the embossing protuberances have top surfaces having the form of a graphical element, in this case leaves.

The second roller 20 is a marrying roller and may be formed of rubber, the outer periphery being covered by a metal layer (e. g. metal plated rubber roller of O. M. Futura).

Additionally, there is provided a counter roller 9 for the embossing roller 10 which is made of rubber.

The apparatus shown in FIG. 3 further comprises a second embossing roller 11 having embossing protuberances on an outer periphery and a counter roller 12 made of rubber. The embossing roller 10 and the embossing roller 11 are associated to each other so that the corresponding embossing protuberances "mesh".

An applicator for applying a mixture of adhesive and bleaching agent on the one side of one ply is provided in association with the embossing roll 10. This applicator comprises an applicator roller 8, an Anilox roll 7 and a reservoir 6 (doctor chamber). That is, a common adhesive applicator may be used to apply the mixture and bleaching agent, wherein the mixture is continuously agitated before applying in the reservoir 6. Such existing application systems for adhesive consisting of an applicator roller, transfer roller and bath can be designed as a so-called immersion roll system in which the transfer roller is immersed into the bath and transports the mixture of adhesive and bleaching agent by means of surface tension and adhesive forces out of the bath. By adjusting the gap between the transfer roller and the applicator or application roller, the amount to be applied can be adjusted. Application rollers may be structured rolls. Recently, transfer rolls have become known having defined pit-shaped depressions in their circumferential surface. Such adhesive transfer rolls are known as Anilox-rollers. Such roll is usually made of ceramic material or it is a roll made of steel or copper and coated with chromium. Excessive adhesive (with bleaching agent) is removed from the surface of the Anilox-roll by means of a blade. The amount is determined by the volume and the number of depressions. Alternative application systems for applying adhesives are based on a spraying equipment (Weko-technique) and may be used as well.

A second possibility to influence the amount of adhesive and bleaching agent transferred is the adjustment of the difference in circumferential speeds of the transfer roll and the applicator roll. Typically, the transfer roll rotates slower than the applicator roll. The circumferential speed of the transfer roll is usually between 5% and 100% of the first circumferential speed of the applicator roll. The bath can be designed as a simple trough, application systems with a blade can also be designed as chamber systems.

The two plies are guided through the corresponding roller nips by means of several guide rollers 5. Additionally web tension control systems (not shown) can be useful.

The function of the apparatus as shown in FIG. 3 is as follows.

Two single plies are fed to the apparatus and separated at the first guide roller 5, one of the plies 14 being guided around (this is not essential, also other guiding paths are conceivable) the rubber roller 9 and the other 13 being guided via other guide rollers 5 to a nip formed between the second embossing roller 11 and the second counter roller 12 which both form a nip. Between this nip a first embossing pattern is imparted to the ply 13. The ply 14 is nipped between the counter roller 9 and the first embossing roller 10 to form a second embossing pattern on the ply 14. The first ply is a colored base paper, which may be colored e.g. by the processes described in WO 96/20310 or WO 89/02952, wherein the base paper's fibers are colored providing a uniform coloration of the base web's surfaces.

Then a mixture of adhesive and bleaching agent is taken from the reservoir 6 and transferred by means of the transfer roller 7 from the reservoir 6 to the applicator roller 8. The applicator roller 8 then transfers the mixture on the side of the ply 14 which faces the applicator roller 8. Preferable amounts reside within 0.2 to 30 $g/m^2$, 0.6 to 6 $g/m^2$ and most preferably between 1 to 4 $g/m^2$. In addition, because of the nipping performed between the rubber roller 9 and the embossing roller 10, only areas of the ply corresponding to the top surfaces of the embossing protuberances on the embossing roller 10 come in contact with the outer periphery of the applicator roller 8 so that only these parts of the ply 14 are printed by the mixture. Therefore, the bleaching agent is only applied locally in the second area 100. The bleaching agent, which according to this example is NaClO of Carl Roth with 3-5% solid content of Henkel's CELLURA MC60, oxidizes the coloring compound. Hence, the second area 100 appears less colored or even white compared to the remainder (first area 110) of the web (ply). Then both plies 14 and 13 subsequently are bonded in the nip formed between the embossing roller 10 and the marrying roller 20. In this nip both webs are interconnected by the adhesive on the ply 14. As the adhesive is only applied in the area corresponding to the top surfaces of the protuberances on the embossing roller 10, the ply bonding is only achieved in these areas.

Afterwards, the two plies being combined leave the marrying roller 12 and are further processed and converted to a final product.

The invention claimed is:

1. A hygiene or wiping product, comprising:

at least one ply of a fibrous web containing cellulose fibers and having a graphical pattern of at least first and second areas, the ply containing an oxidizable dyestuff providing a coloration to the ply, the second area of the ply containing a bleaching agent and an adhesive; and an additional ply of fibrous web, wherein the at least one ply of fibrous web and the additional ply of fibrous web are bonded by the adhesive in the second area of the at least one ply, wherein the oxidizable dyestuff is at least partly bleached in the second area so that the at least one ply is less colored in the second area than in the first area, and wherein the first area is essentially free of the bleaching agent and the adhesive.

2. The hygiene or wiping product as set forth in claim 1, wherein the at least one ply has an embossing at least in the second area.

3. The hygiene or wiping product as set forth in claim 1, further comprising a functional compound within the second area.

4. The hygiene or wiping product as set forth in claim 1, wherein the oxidizable dyestuff is a cationic direct dyestuff.

5. A hygiene or wiping product, comprising:

a first ply of a fibrous web containing cellulose fibers and having a graphical pattern of at least first and second areas, the first ply containing an oxidizable dyestuff providing a coloration of the first ply in the first area wherein the oxidizable dyestuff is at least partly bleached by a bleaching agent in the second area so that the first ply is less colored in the second area than in the first area;

a colored adhesive in portions of the second area; and a second ply of a fibrous web containing cellulose fibers bonded to the first ply by the colored adhesive, wherein the first area is essentially free of the bleaching agent and the adhesive.

6. The hygiene or wiping product as set forth in claim 5, wherein the oxidizable dyestuff is a cationic direct dyestuff.

7. The hygiene or wiping product as set forth in claim 1, wherein the second area is white or substantially white.

8. The hygiene or wiping product as set forth in claim 5, wherein the second area is white or substantially white.

9. The hygiene or wiping product as set forth in claim 1, wherein the product does not contain any chloride.

10. The hygiene or wiping product as set forth in claim 5, wherein the product does not contain any chloride.

* * * * *